US012773060B2

(12) United States Patent
Veale et al.

(10) Patent No.: US 12,773,060 B2
(45) Date of Patent: Oct. 27, 2026

(54) HYGIENIC CURTAIN HANDLE SYSTEM

(71) Applicant: THE REGENTS OF THE UNIVERSITY OF CALIFORNIA, Oakland, CA (US)

(72) Inventors: Jeffrey L. Veale, Los Angeles, CA (US); Randi Hissom, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 17/996,270

(22) PCT Filed: Apr. 15, 2021

(86) PCT No.: PCT/US2021/027450

§ 371 (c)(1),
(2) Date: Oct. 14, 2022

(87) PCT Pub. No.: WO2021/211816

PCT Pub. Date: Oct. 21, 2021

(65) Prior Publication Data

US 2023/0225539 A1 Jul. 20, 2023

Related U.S. Application Data

(60) Provisional application No. 63/145,528, filed on Feb. 4, 2021, provisional application No. 63/010,520, filed on Apr. 15, 2020.

(51) Int. Cl.
*A45C 13/26* (2006.01)
*A47H 5/08* (2006.01)

(52) U.S. Cl.
CPC ..... *A47H 5/08* (2013.01)

(58) Field of Classification Search
CPC ..... E06B 9/78; E06B 2009/425; A44B 19/16; A45C 13/26; A47H 13/01; A47H 5/02; A47H 5/08; Y10T 24/32; Y10T 24/44889; Y10T 24/44521; Y10T 24/44872; Y10T 24/44915
See application file for complete search history.

(56) References Cited

U.S. PATENT DOCUMENTS 1,538,877 A * 5/1925 Baty ..... E05D 1/04 16/355
1,908,449 A * 5/1933 Rundel ..... E06B 9/78 160/349.1
1,909,109 A * 5/1933 Kopfstein ..... E06B 9/42 160/394
2,484,609 A * 10/1949 Clark ..... E05D 1/04 16/269

(Continued)

FOREIGN PATENT DOCUMENTS

AT 502863 A1 * 6/2007 ..... A45F 5/02
WO WO-2014028794 A2 * 2/2014 ..... A47H 5/00

*Primary Examiner* — Chuck Y Mah
(74) *Attorney, Agent, or Firm* — Riverside Law LLP

(57) ABSTRACT

A curtain handle system includes a first layer configured to mate with a second layer so that the first and second layers attach to curtain disposed therebetween. A curtain handle system includes a curtain attachment element and a user handle configured to interface with and temporarily engage the curtain attachment element.

6 Claims, 5 Drawing Sheets

(56) References Cited

U.S. PATENT DOCUMENTS 2,537,828 A * 1/1951 Hoffman ..... E06B 9/78 D6/581
2,852,802 A * 9/1958 Seby ..... E05D 1/04 16/390
3,070,234 A * 12/1962 Deitchman ..... A47B 57/40 16/269
3,484,910 A * 12/1969 Gossling ..... E06B 9/78 24/561
3,912,140 A * 10/1975 Franges ..... A45F 5/1046 294/166
3,994,045 A * 11/1976 Roy ..... E05D 11/06 16/355
4,307,486 A * 12/1981 Matsumoto ..... E05D 1/04 16/261
4,979,266 A * 12/1990 Roy ..... E05D 1/04 16/376
D376,971 S * 12/1996 Schutz ..... D8/327
5,682,653 A * 11/1997 Berglof ..... G09F 1/10 224/183
6,223,804 B1 * 5/2001 Toti ..... E06B 9/386 160/199
6,447,149 B1 * 9/2002 Kaforey ..... A61B 46/10 362/399
6,499,188 B1 * 12/2002 Cheng ..... A45C 13/005 16/269
7,051,404 B2 * 5/2006 Roy ..... E05D 1/04 16/337
9,138,888 B1 * 9/2015 Worden ..... B25G 3/38
9,901,771 B1 * 2/2018 Silver ..... A63B 22/0605
10,722,062 B1 * 7/2020 Clarke ..... A47H 5/02
2006/0006678 A1 * 1/2006 Herron ..... E05B 1/0069 292/336.3
2006/0230576 A1 * 10/2006 Meine ..... A47K 17/00 16/110.1
2007/0084567 A1 * 4/2007 Chen ..... E06B 9/32 160/84.05
2012/0144610 A1 * 6/2012 Balzano ..... E05B 1/0069 15/104.92
2013/0248065 A1 * 9/2013 Lewis ..... E03D 5/02 150/154
2015/0191969 A1 * 7/2015 Allen ..... E06B 9/18 160/235
2022/0079159 A1 * 3/2022 Hackemeyer ..... A01N 25/24

* cited by examiner

HYGIENIC CURTAIN HANDLE SYSTEM

CROSS-REFERENCE TO RELATED APPLICATIONS

This application is a U.S. National Phase Application filed under 35 U.S.C. § 371 claiming benefit to International Patent Application No. PCT/US2021/027450, filed Apr. 15, 2021, which claims priority to U.S. Provisional Application No. 63/145,528, filed on Feb. 4, 2021, and U.S. Provisional Application No. 63/010,520, filed on Apr. 15, 2020, each of which is incorporated herein by reference in its entirety.

BACKGROUND OF THE INVENTION

Flexible enclosures such as medical patient privacy curtains typically provide access to a patient area for medical professionals or hospital guests by manually sliding the flexible enclosure between an open and closed position. The opening and closing of such enclosures typically involves gripping the curtain and pushing, pulling or otherwise sliding the curtain to further open or close the enclosure. The curtains have surfaces frequently touched by medical professionals or hospital guests, which may be referred to as "touch surfaces" or "contact surfaces", and certain areas of the curtain may naturally be a higher frequency touch surface than other areas of the curtain. Such touch surfaces are often easily contaminated and may represent vectors for contamination that can lead to the spread of disease through contact transference of contamination. For example, Influenza and Covid-19 viruses may be transferred to such touch surfaces, and then transmitted to the next person in contact with the touch surface.

Patient privacy curtains are cleaned infrequently, touched numerous times at different areas by clinicians and hospital guests, and are contributing to spread of viruses such as Covid-19, superbugs and hospital acquired infections. Typically, there is not handwashing or glove changes in between shutting the curtain and examining the patient, or examining the patient and opening the curtain. It is estimated by the US Center for Disease Control (CDC) that influenza viruses affect 5% to 20% of the U.S population each year, and novel viruses can affect the population at much higher rates. Contamination, such as Covid-19 virus can transfer from a contaminated touch surface and enter one's body when hands that have previously touched an infected surface also touch the mouth, nose, eyes or other vulnerable areas of entry to the body.

Thus, there is a need in the art for a device that offers hygienic access to touch surfaces such as patient privacy curtains that is simple to use, easy to clean, and minimizes the spread of virus and contamination of surfaces between uses.

SUMMARY OF THE INVENTION

In one embodiment, a curtain handle system includes a first layer configured to mate with a second layer so that the first and second layers attach to a curtain disposed therebetween. In one embodiment, the first and second layer each includes a plurality of traction ridges configured to mate with each other. In one embodiment, the first layer includes a first plurality of magnets configured to pair with a second plurality of magnets in the second layer. In one embodiment, the first and second layer are connected by a hinged portion. In one embodiment, the hinged portion defines an opening. In one embodiment, the hinged portion forms a snap fit for attaching and detaching the first and second layers. In one embodiment, the hinged portion includes a first tubular structure disposed at one end of the first layer and a second tubular structure disposed at one end of the second layer. In one embodiment, the first tubular structure is configured to nest within the second tubular structure. In one embodiment, the first tubular structure includes a first gap between an edge of the first tubular structure and the first layer, and wherein the second tubular structure includes a second gap between an edge of the second tubular structure and the second layer. In one embodiment, the first and second layers form an opening.

In one embodiment, a curtain handle system includes a curtain attachment element; and a user handle configured to interface with and temporarily engage the curtain attachment element. In one embodiment, the user handle includes a hooked distal end. In one embodiment, the curtain attachment includes an opening. In one embodiment, the user handle is configured as a sleeve that interfaces over the curtain attachment element.

BRIEF DESCRIPTION OF THE DRAWINGS

The foregoing purposes and features, as well as other purposes and features, will become apparent with reference to the description and accompanying figures below, which are included to provide an understanding of the invention and constitute a part of the specification, in which like numerals represent like elements, and in which.

DETAILED DESCRIPTION OF THE INVENTION

Figure 1A:
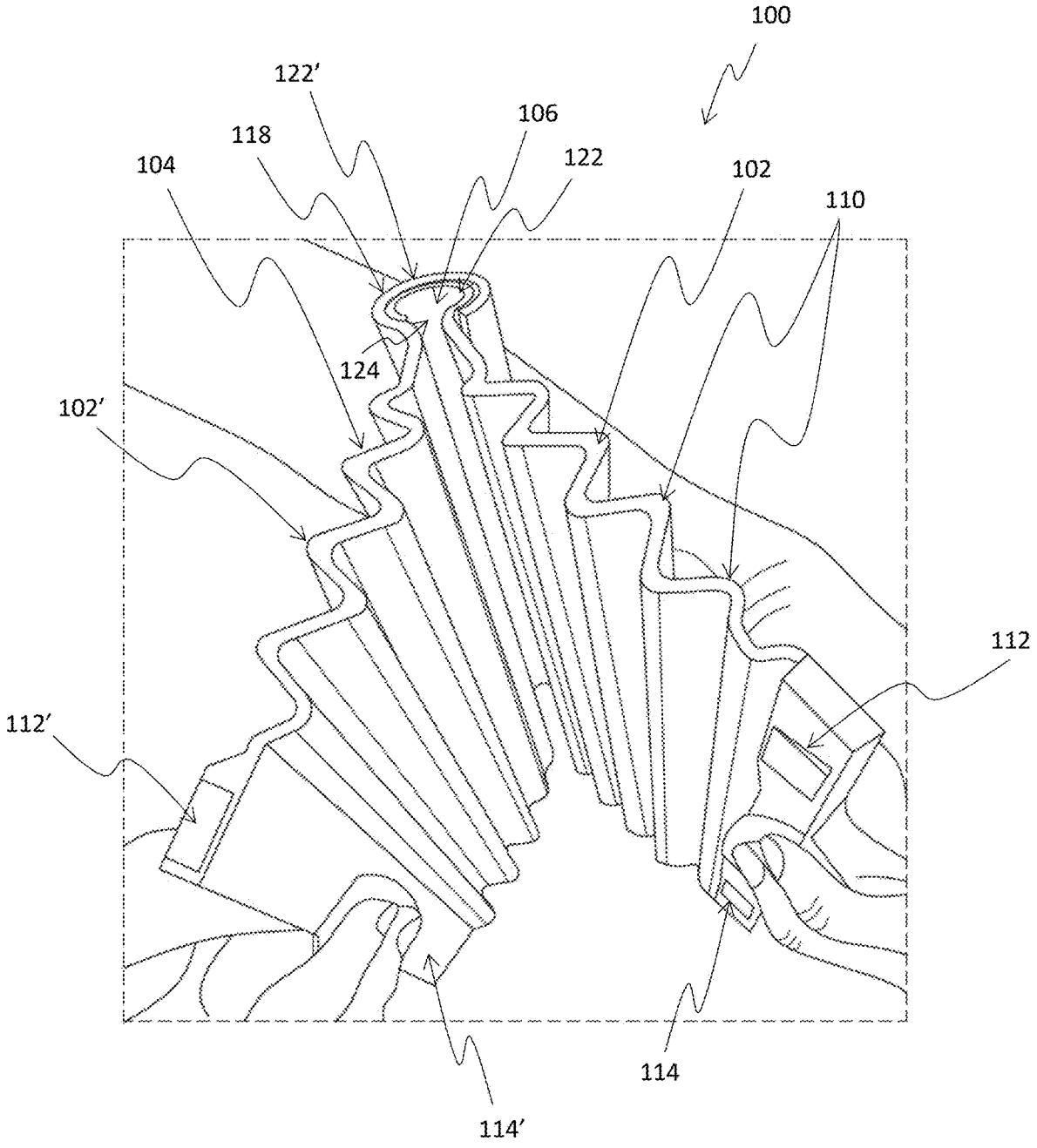
FIG. 1A is a top perspective view of a curtain handle system (partially open) according to one embodiment.
Figure 1B:
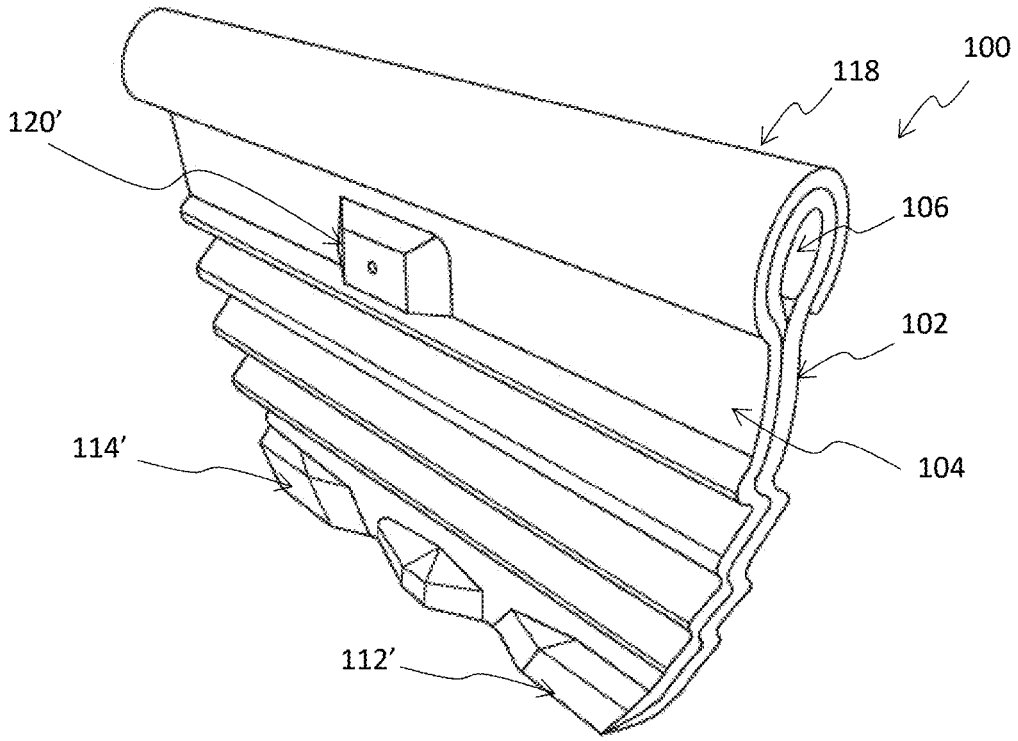
FIG. 1B is a top perspective view of the front side of the curtain handle system (closed)
Figure 1C:
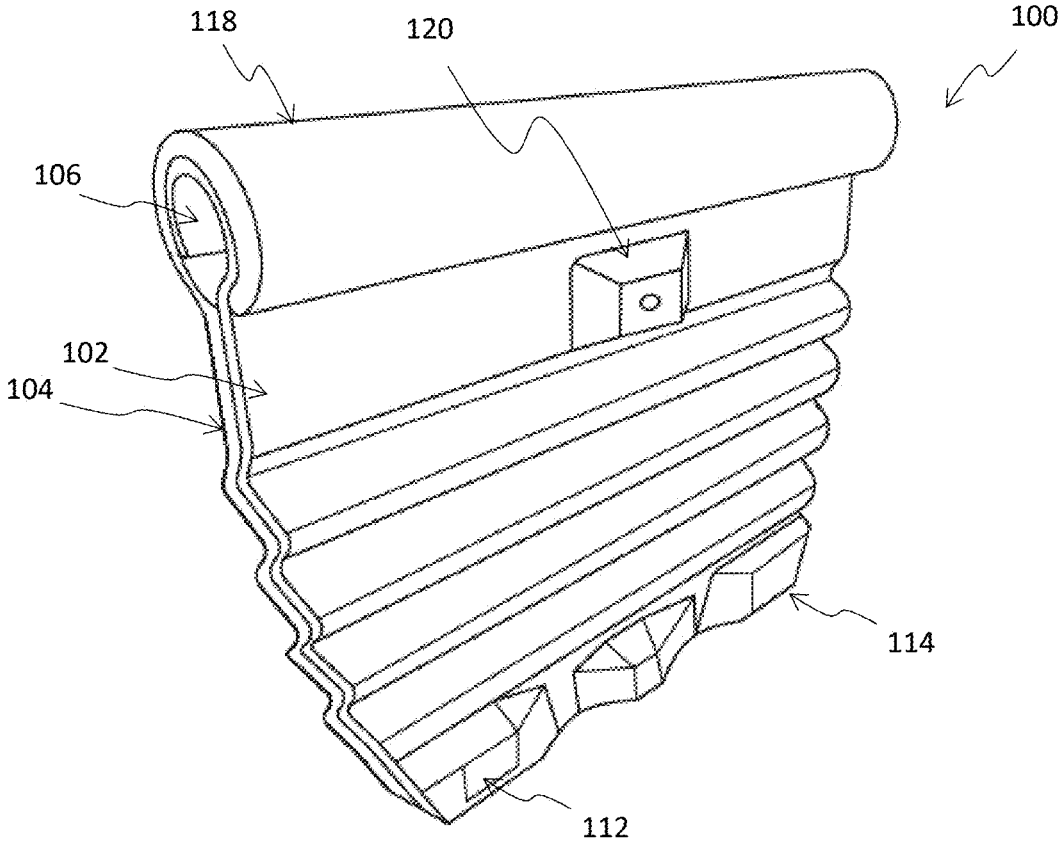
FIG. 1C is an top perspective view of the back side of a curtain handle system.
Figure 1D:
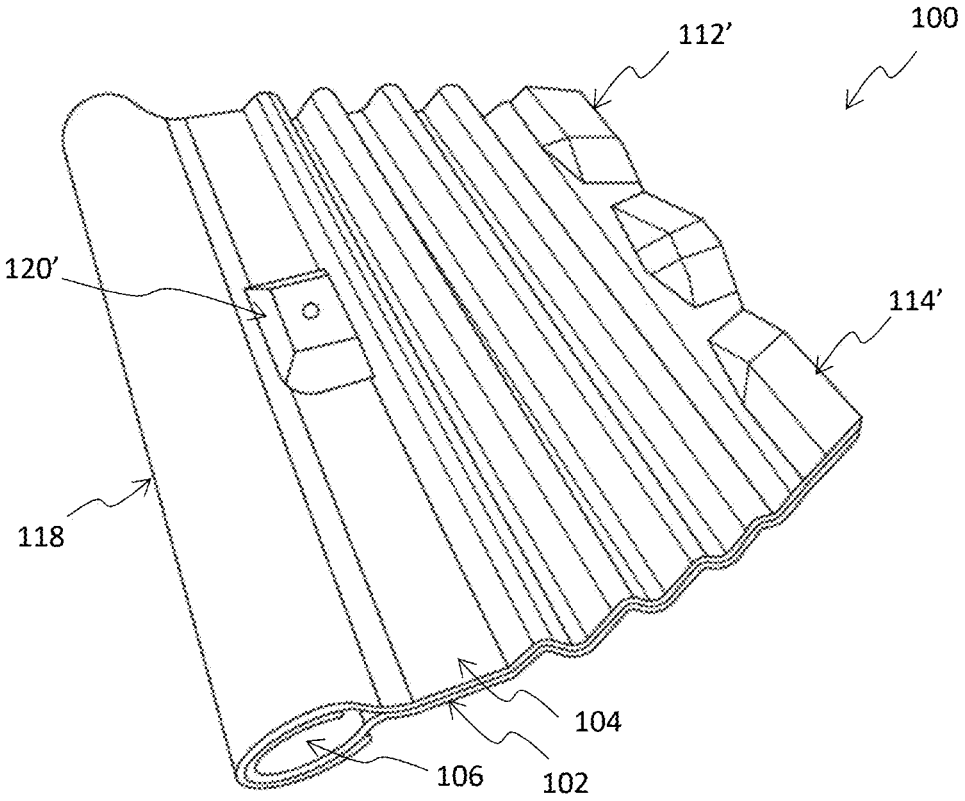
FIG. 1D is an alternate perspective view of the front side of the curtain handle system.
Figure 1E:
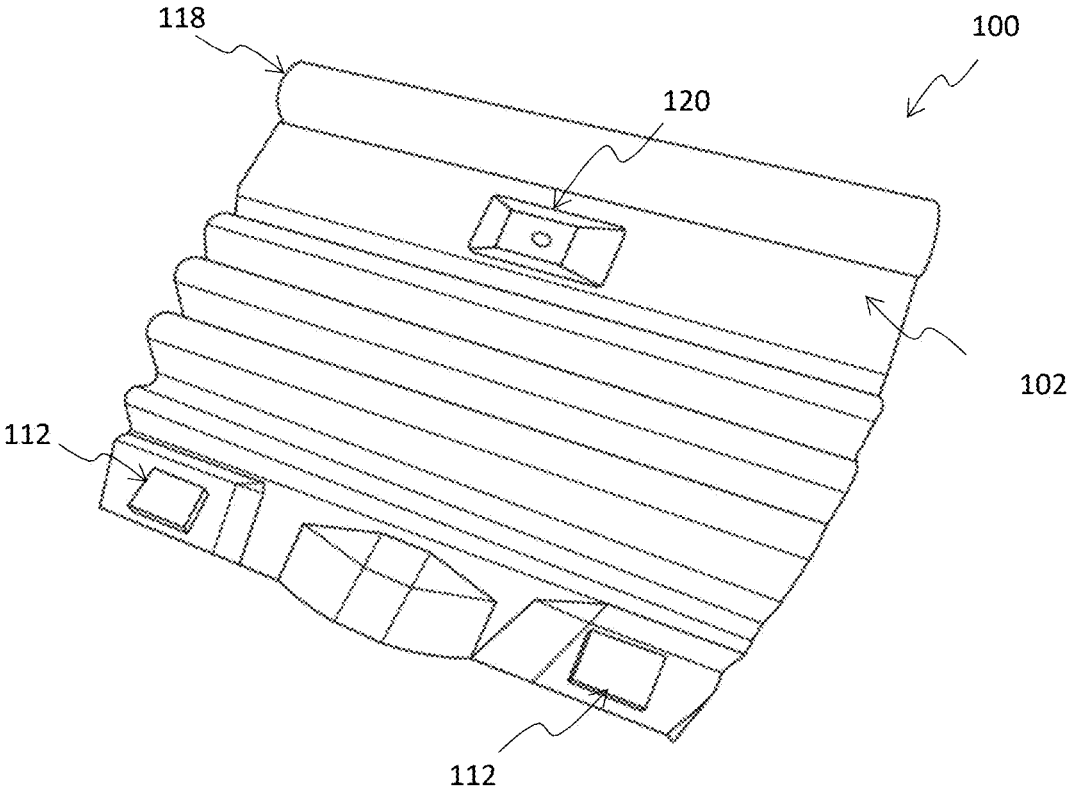
FIG. 1E is an alternate perspective view of the back side of the curtain handle system.
Figure 1F:
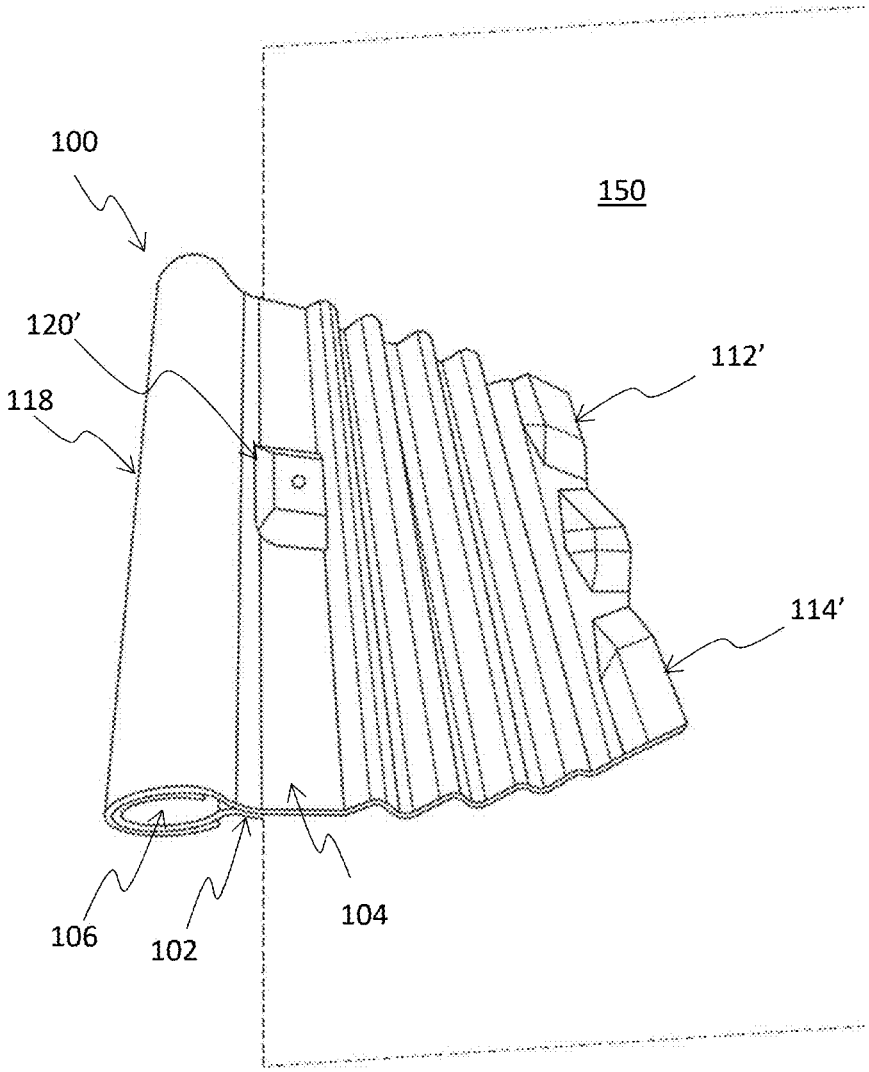
FIG. 1F is a perspective view of the curtain handle system closed over and attached to a curtain.

It is to be understood that the figures and descriptions of the present invention have been simplified to illustrate elements that are relevant for a more clear comprehension of the present invention, while eliminating, for the purpose of clarity, many other elements found in curtain handle systems. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Ranges: throughout this disclosure, various aspects of the invention can be presented in a range format. It should be understood that the description in range format is merely for convenience and brevity and should not be construed as an inflexible limitation on the scope of the invention. Where appropriate, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Referring now in detail to the drawings, in which like reference numerals indicate like parts or elements throughout the several views, in various embodiments, presented herein are embodiments of a curtain handle system.

Embodiments of the present invention centers around a single touch-point handle on flexible enclosures such as but not limited to a curtain or door, that can be rapidly and hygienically replaced or sanitized between each single use. Embodiments of the invention could help reduce spread of infections that are risking patients and medical professionals.

With reference now to FIGS. 1A-1F, in one embodiment, a curtain handle system 100 includes a first layer 102 and second layer 104 configured to mate with each other over portion of a curtain 150 (e.g. an edge of the curtain), sandwiching the curtain 150 therebetween to attach to it (FIG. 3A showing an open state and FIGS. 3B-3F showing a closed state). The first and second layers 102, 104 can be formed with complimentary geometries that allows for a flush-mating and/or snap fit configuration over the curtain 150. The layers can include multiple traction ridges 110 for providing a better grip on the curtain 150 while sandwiching over a portion of the curtain 150, which also provides users a better grip for pulling the curtain 150 open and shut.

The first and second layers 102, 104 can also have aligned securement elements 112, 112', 114, 114', 120, 120' for securing a tight fit over the curtain, such as a series of opposing magnets aligned at one or more portions of the first and second layers 102, 104 so that they overlap when the system 100 is closed. In one embodiment, the securement elements 112, 112', 114, 114', 120, 120' can include structural elements providing a snap fit through openings in the curtain layer or with the curtain layer remaining therebetween.

The first and second layers 102, 104 of the handle system 100 can detach or remain connected via a hinged portion 118 that allows the first and second layers 102, 104 to open and close for removing from and attaching to the curtain 150. One or more portions of the mated curtain handle system 100 can include a loop or opening 106 that allows for a hook or handle to interface with and pull the curtain system 100 for opening and shutting the curtain 150. The opening 106 in one embodiment can be incorporated into the hinged portion 118. The opening 106 or hinged portion 118 can also be utilized for attaching a functional element for operating the curtain such as that described in other embodiments. The hinged portion 118 can form a snap fit for attaching and detaching the first and second layers 1002, 104.

The hinged portion 118 can include a first tubular structure 122 at one end of the first layer 102 and a second tubular 122' structure at one end of the second layer 102 such that the first tubular structure 122 is configured to nest within the second tubular structure 122' and can be configured to form a snap fit for easy separation. The first and second tubular structures 122, 122' can have a gap 124 between an edge of the tubular structure and their own respective layer, which allows in part facilitating a snap fit hinge 118 by providing a flex point for nesting/snap-fitting the tubular structures 122, 122' and can also accommodate curtain material with the opening 106, which can be bunched within the opening or in a flat layer.

The system 100 can be made of materials known in the art such as plastic and can include one or more portions that are translucent. Embodiments described herein can also be configured to attach to the curtain according to aspects of the system described in alternate embodiments. Embodiments are easy to remove, replace, clean ad sanitize, and can further be made of materials compatible with autoclaving systems and other types of sanitizing equipment, treatments and formulations.

Figure 2A:
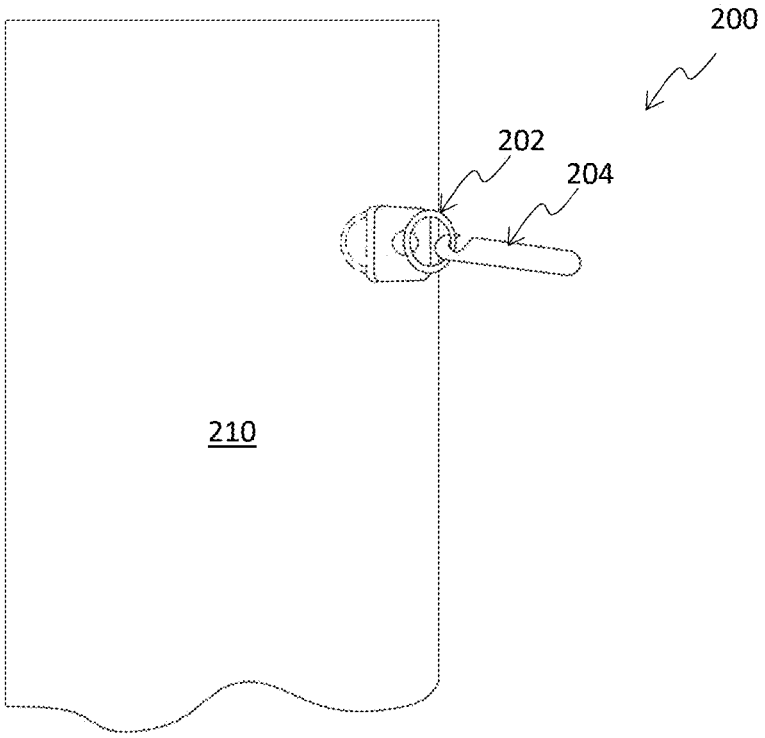
FIG. 2A is a diagram of a curtain handle system according to one embodiment.

With reference now to FIG. 2A, in one embodiment, a curtain handle system 200 includes a curtain attachment element 202, for example hardware that forms a full or partial opening such as a ring as shown, or another type of element such as for example a hook. The attachment element can also be flexible such as for example a textile mesh or netting, or and opening in the curtain material itself (e.g. a button hole sewed into the curtain fabric). In another embodiment, the attachment element can be magnetic or a hook and loop arrangement. The user handle 204 is configured to interface with and temporarily engage the curtain attachment 202 element, allowing the user to manipulate the curtain 210 via contact with the user handle 204 only. The corresponding user handle can be a device that is compatible for interfacing with the attachment element for temporarily attaching to it and sliding the curtain open or shut. For example, the user handle can be a hook if the curtain has a ring, mesh, netting, or a buttonhole; or a ring if the curtain has a hook; or a magnetic or hook and loop fastener as appropriate. It will be apparent to those having ordinary skill in the art that other types of interfacing elements known in the art can be utilized for the curtain attachment element or the user handle. The curtain attachment element can be permanently or temporarily/removably attached to the curtain.

Figure 2B:
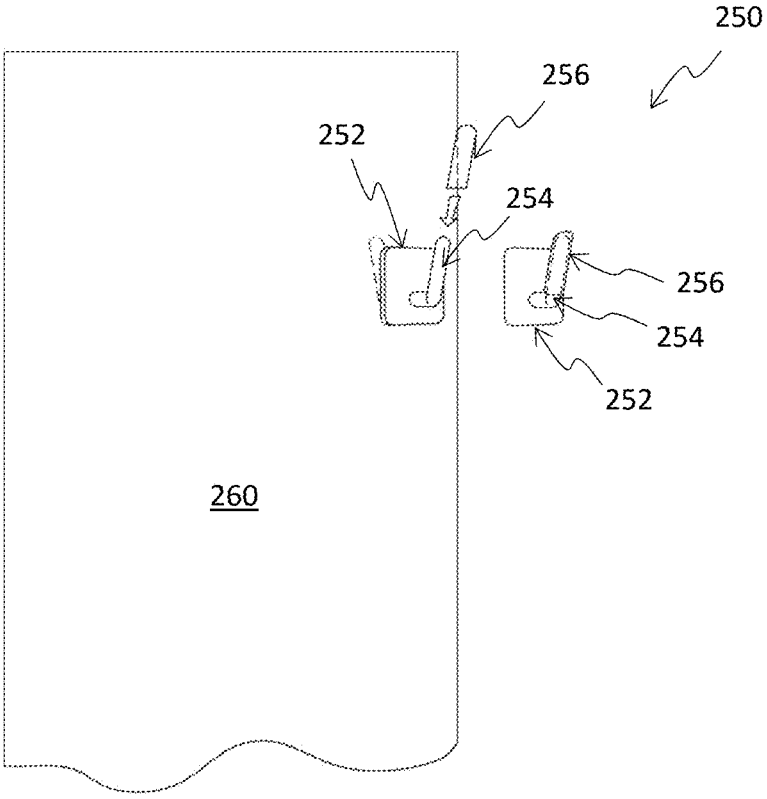
FIG. 2B is a diagram of the curtain handle system with the sleeve removed.

With reference now to the system 250 of FIG. 2B, according to one embodiment, the curtain attachment element 252 assumes the shape of a handle 254, and the user handle is a sleeve 256 that is configured to cover the handle-shaped curtain attachment element 252 for grasping and opening or closing the curtain 260.

In one embodiment, hooks (e.g. FIG. 2A) can be used to avoid handle contamination. In one embodiment, the hooks are used with an existing handle having a closed structure or figure. In one embodiment, the handle can have a rectangular, circular, square or any other suitable shape. In one embodiment, the hook can engage the closed structure and be pulled back by a user to open a flexible enclosure without risk of getting infected by a virus already on the surface of the handle.

In one embodiment, the hook may be disposable after single use. In one embodiment, the hook can be personalized to each user, so that every user can use their own hook to open a flexible enclosure, without risking cross-contamination. In one embodiment, the hook is able to be sterilized or autoclaved between uses.

In one embodiment, the hook may be made from any material such as metals, plastics, polymers and combinations thereof. In one embodiment, the material can be stiff to allow engaging with the handle without losing the hook shape.

In one aspect, a sanitary and elasticized sleeve is provided (e.g. FIG. 2B) for use with an existing handle on a flexible enclosure. In one embodiment, the sleeves include an elasticized and compressible/flattenable body having a substantially three-dimensional shape conforming to the shape of a handle with an inner face, an outer face, and an open inserting end. In one embodiment, the body of the sleeves defines a substantially rubberized or plasticized material. In one embodiment, the sleeves are opaque or transparent. In one embodiment, the sleeves may be elastically stretched so as to apply around the configuration of the handle. In one embodiment, the sleeves are capable of being applied to any of a plurality of differently configured handles (knobs, levers, etc.). Alternatively, embodiments of the sleeves can be packaged in pluralities of differing sizes to accommodate the different types and sizes of handles.

In one embodiment, the inner face of the sleeve may be covered with disinfecting material. The particular use of the disinfecting material is intended to kill off as many germs as possible adhering to the exposed surfaces of the handle and in attempt to provide the maximum degree of protection to the user.

In one embodiment, the sleeves are flat sheets in convenient sizes for coverage of commonly shared surfaces areas. In one embodiment, the sleeves are produced as rolls in sizes which allow a single person to easily hold and tear off individual sections for a cover of desired size and as flat sheets in convenient sizes for coverage of handles. The self-adhesive on the one side of the sleeve's affixes to any surface quickly without excessive handling. The removable adhesive also allows the sleeve to be easily removed from the surface it covers in one piece when users have finished with the use of the equipment.

In one embodiment, plurality of the sleeves may be carried within a suitable dispensing device and to then apply each of the sleeves to each of a succeeding plurality of individual handles, such as is typical in public places. The simplicity of the sleeves of the present invention is further such that they may be disposable after every use. In one embodiment, the dispensing device can be attached to the flexible enclosure device for ease of use. In one embodiment, the dispensing device can be placed near the flexible enclosure device.

In one embodiment, the handle is permanently attached to the flexible enclosure. In one embodiment, the handle is easily attached and removed from the flexible enclosure device so as to enable removal of the flexible enclosure device for laundering or replacement or the like. Embodiments can be used for any type of facility, and can be adapted for high frequency touch surfaces for restrooms, changing rooms and the like.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention.

What is claimed is:

1. A curtain handle system comprising:

a first layer configured to mate with a second layer so that the first and second layers attach to a curtain disposed therebetween;

wherein the first and second layers each have a tubular structure disposed on one end thereof, each tubular structure having a gap between a longitudinal edge of the tubular structure and the respective layer to allow the tubular structures to engage with each other to form a snap fit hinge having a length, with an opening passing through the length of the hinge;

wherein each of the gaps defines a flex region for snap-fitting the tubular structures to form said hinge.

2. The curtain handle system of claim 1, wherein the first and second layer each comprise a plurality of traction ridges configured to mate with each other.

3. The curtain handle system of claim 2, wherein each of the plurality of traction ridges has a length that is equal to and runs parallel to the length of the hinge.

4. The curtain handle system of claim 1, wherein the first layer comprises a first plurality of magnets configured to pair with a second plurality of magnets in the second layer.

5. The curtain handle system of claim 1, wherein the tubular structure of the first layer is configured to nest within the tubular structure of the second layer.

6. A curtain handle system comprising:

a first layer having a first end and an opposing second end defining a length, with a top edge and a bottom edge along the length, the first layer having a tubular structure at the first end curving from the top edge toward the bottom edge, at least one magnet at the second end and a plurality of traction ridges running parallel to the tubular structure from the top edge to the bottom edge; and a second layer having a first end and an opposing second end defining a length, with a top edge and a bottom edge along the length, the second layer having a tubular structure at the first end curving from the top edge toward the bottom edge, at least one magnet at the second end and a plurality of traction ridges running parallel to the tubular structure from the top edge to the bottom edge;

wherein the traction ridges of the first layer are configured to mate with the traction ridges of the second layer so that the first and second layers attach to a curtain disposed therebetween;

wherein the tubular structures of the first and second layers engage together to form a snap fit hinge extending from the top edges to the bottom edges of the first and second layers, the snap fit hinge defining an opening extending from the top edges to the bottom edges of the first and second layers;

wherein the snap fit hinge includes a flex region, wherein the flex region is formed from a first gap between a longitudinal edge of the first tubular structure and the first layer and a second gap between a longitudinal edge of the second tubular structure and the second layer.

* * * * *